US006948552B2

(12) United States Patent
Kosugi et al.

(10) Patent No.: US 6,948,552 B2
(45) Date of Patent: Sep. 27, 2005

(54) CEILING EMBEDDED TYPE INDOOR UNIT

(75) Inventors: Shinichi Kosugi, Shimizu (JP); Takashi Sano, Shimizu (JP); Yoshiki Hata, Shimizu (JP); Naoki Shikazono, Ibaraki-ken (JP)

(73) Assignee: Hitachi, Ltd., Tokyo (JP)

( * ) Notice: Subject to any disclaimer, the term of this patent is extended or adjusted under 35 U.S.C. 154(b) by 417 days.

(21) Appl. No.: 09/978,631

(22) Filed: Oct. 18, 2001

(65) Prior Publication Data

US 2004/0172962 A9 Sep. 9, 2004

Related U.S. Application Data

(63) Continuation of application No. 09/357,384, filed on Jul. 20, 1999, now abandoned.

(51) Int. Cl.[7] ..... F24H 9/06; F24H 3/02; F25D 23/12; F25D 21/14

(52) U.S. Cl. ..... 165/53; 165/54; 165/120; 165/150; 62/263; 62/285

(58) Field of Search ..... 165/53, 54, 120, 165/150; 62/263, 285

(56) References Cited

U.S. PATENT DOCUMENTS

| | | | | | |
|---|---|---|---|---|---|
| 4,677,279 | A | * | 6/1987 | Wesseltoft | 392/435 |
| 4,854,375 | A | * | 8/1989 | Farina et al. | 165/53 |
| 5,884,500 | A | * | 3/1999 | Wetzel | 62/259.1 |
| 5,884,694 | A | * | 3/1999 | Tanenbaum | 165/125 |
| 6,345,667 | B1 | * | 2/2002 | Hata et al. | 165/200 |
| 6,554,059 | B2 | * | 4/2003 | Hata et al. | 165/53 |
| 6,802,361 | B2 | * | 10/2004 | Hatanaka | 165/53 |
| 6,877,331 | B2 | * | 4/2005 | Takeuchi et al. | 62/259.1 |

FOREIGN PATENT DOCUMENTS

| | | | | |
|---|---|---|---|---|
| DE | 195 12 275 | | 4/1995 | |
| EP | 0 789 196 | | 9/1996 | |
| EP | 0 793 061 | | 9/1997 | |
| GB | 2 314 924 | | 7/1997 | |
| JP | 63-123929 | | 8/1988 | |
| JP | 63-286648 | | 11/1988 | |
| JP | 1-66522 | * | 4/1989 | F24F/1/00 |
| JP | 2000-220859 | * | 8/2000 | F24F/1/00 |

* cited by examiner

*Primary Examiner*—Henry Bennett
*Assistant Examiner*—Nihir Patel
(74) *Attorney, Agent, or Firm*—Antonelli, Terry, Stout & Kraus, LLP

(57) ABSTRACT

There is disclosed a ceiling embedded type indoor unit which is reduced in height to provide a compact unit body size and which provides a large cooling/heating capability. The ceiling embedded type indoor unit comprising two air blowoff ports and embedded in a ceiling comprises a heat exchanger formed in a U-shape with sides of the U-shape being disposed on long sides of a unit body and connected to a header pipe for circulating a coolant at one end of an open side of the U-shape, air blowoff ports disposed to extend from a bottom side the U-shape, and a centrifugal blower disposed aside to the bottom side of the U-shape relative to a substantial center of a length direction of the sides of the U-shape.

7 Claims, 10 Drawing Sheets

CEILING EMBEDDED TYPE INDOOR UNIT

CROSS REFERENCE TO RELATED APPLICATION

This application is a continuation of U.S. application Ser. No. 09/357,384, filed Jul. 20, 1999, now abandoned.

BACKGROUND OF THE INVENTION

The present invention relates to a ceiling embedded type indoor unit of an air conditioner, particularly to a two-direction blowoff indoor unit, provided with two blowoff ports, which is made smaller for its capability.

In a conventional ceiling embedded type indoor unit provided with four air blowoff ports or so-called four-direction blowoff unit, it is known to dispose a squared annular heat exchanger or two L-shaped heat exchangers in combination around a centrifugal blower. Moreover, for the ceiling embedded type indoor unit for four-direction blowoff, it is described in JP-U-63-123929 that a heat exchanger formed in U-shape is disposed around the centrifugal blower and that two of four air blowoff ports are closed.

Moreover, in the two-direction blowoff ceiling embedded type indoor unit provided with two air blowoff ports, a sirocco fan which is a large-diameter multi-vane fan is often used in order to provide a large amount of air and two heat exchangers are often arranged along the air blowoff ports.

Furthermore, it is known that in the two-direction blowoff ceiling embedded type indoor unit a heat exchanger formed in a circular shape is disposed around the centrifugal blower such as a turbo fan to make the entire unit thin.

In the above-mentioned prior arts, the indoor unit in which the sirocco fan is used becomes high height because a fan casing is needed and the like. This restricts a degree of freedom in installation when a unit body is installed on the back of ceiling. Specifically, for the ceiling embedded type indoor unit, regardless of four or two-direction blowoff, an indoor unit of which height is as low as possible is demanded so that it can be installed even in a small-scale office with a small ceiling height.

Moreover, the indoor unit disclosed in JP-U-63-123929 is made to the two-direction blowoff type by closing two of the air blowoff ports of the four-direction blowoff type. Therefore, the indoor unit disclosed in JP-U-63-123929 does not take it into consideration that it is preferable to make the air blowoff ports longer in comparison with the body of the unit in the two-direction blowoff type since the two-direction blowoff indoor unit may be installed, for example, in an elongated room, narrow place, or room corner.

Furthermore, the unit in which the circular heat exchanger is disposed around the turbo fan has difficulty in developing products in response to several cooling/heating capacities or units of which air blowoff ports are lengthened and in improving the air flow distribution to the heat exchanger.

An object of the present invention is to provide a two-direction blowoff ceiling embedded type indoor unit which is reduced in height and which is a large cooling/heating capability and an excellent air flow distribution to a heat exchanger although the body of the unit is small and compact.

Another object of the present invention is to provide a two-direction blowoff ceiling embedded type indoor unit which can easily cope with various capacities of the cooling/heating capability.

As described above, an object of the present invention is to solve at least one of the above-mentioned problems.

SUMMARY OF THE INVENTION

To attain the above-described objects, according to the present invention there is provided a ceiling embedded type indoor unit comprising a unit body, a heat exchanger, a blower, an air inlet port, and air blowoff ports, said unit body being a rectangular shape as seen from an indoor side and being provided with two air blowoff ports on its long sides and being installed so as to be embedded in a ceiling, wherein said heat exchanger is formed in a U-shape, sides of the U-shape being disposed on the long sides of the unit body, and one end of an open side of the U-shape being connected to a header pipe for circulating a coolant, and said air inlet port is constituted to extend from a bottom side of the U-shape heat exchanger in a longitudinal direction of the unit body, and said blower is of a centrifugal type blower set aside to the bottom side of the U-shape with respect to a substantial center of the side of the U-shape heat exchanger.

The heat exchanger is formed in the U-shape, and connected to the header pipe on one end of the open side of the U-shape. Therefore, when the height of the heat exchanger is constant, it is possible to arrange the heat exchanger such that an effective area of the heat exchanger becomes large relative to a width dimension of the unit body. Moreover, since the air blowoff ports are disposed to extend from the bottom side of the U-shape heat exchanger in the longitudinal direction of the unit body, it is possible to sufficiently lengthen the air blowoff ports relative to the length of the unit body or the heat exchanger. Furthermore, since the centrifugal blower is disposed aside toward the bottom side of the U-shape, the air from the centrifugal blower is fed to the air blowoff ports not only via the sides but also the bottom side of the U-shape.

By the above-mentioned constitution, even when the height of the indoor unit is reduced, it is possible to make the cooling/heating capability large and the air flow distribution to the heat exchanger good. Moreover, even when the cooling capability is made large, it is possible to easily cope with various capacities of cooling/heating capability since it is sufficient only to lengthen the length of the U-shaped heat exchanger.

According to another aspect of the present invention, there is provided a ceiling embedded type indoor unit which has a unit body, a heat exchanger, a blower, an air inlet port, and air blowoff ports, wherein the heat exchanger has a height of 220 to 260 mm and is formed in a U-shape, and the air blowoff ports are constituted to extend from a bottom side of the U-shape heat exchanger in a longitudinal direction of the unit body, and the blower is of a centrifugal type disposed aside toward a bottom side of the U-shape relative to a substantial center in a length direction of the heat exchanger, and the unit body is provided with blowoff ports on two sides, respectively, and has a width of 800 to 1500 mm, depth of 600 to 640 mm and height of 260 to 300 mm.

By this constitution, since the heat exchanger is formed in the U-shape and its height is in the range of 220 to 260 mm, it is possible to arrange the heat exchanger such that an effective area of the heat exchanger becomes large by lengthen the length thereof, while the height of the body is sufficient low to make the height of the body to be 260 to 300 mm. Moreover, since the air blowoff ports are arranged to extend from the bottom side of the U-shape heat exchanger, it is possible to sufficiently lengthen also the length of the air blowoff ports relative to the unit body size with the width of 800 to 1500 mm and depth of 600 to 640 mm or relative to the length of the heat exchanger. Furthermore, since the centrifugal blower is arranged aside toward the bottom side of the U-shape, the air from the centrifugal blower is fed to the air blowoff ports via not only the sides but also the bottom side of the U-shape. Therefore, even when the length of the air blowoff ports is lengthened relative to the unit body width of 800 to 1500 mm, the area of the heat exchanger can be effectively used up to its tip end.

According to further aspect of the present invention there is provided a ceiling embedded type indoor unit which has a unit body, a heat exchanger, a blower, an air inlet port, and air blowoff ports, wherein the heat exchanger is formed in a U-shape and connected to a header pipe for circulating a coolant on an open side of the U-shape, the air blowoff ports are formed on two sides of the unit body, respectively and constituted to extend from a bottom side of the U-shape heat exchanger in a longitudinal direction of the unit body, the blower is of a centrifugal type disposed aside toward the bottom side of the U-shape relative to a substantial center in a length direction of the side of the U-shape heat exchanger, and a water receptacle having a sectional shape with gradients in a height direction and substantially symmetrical with respect to the substantial center in a depth direction of the unit body at the bottom side of the U-shape heat exchanger.

With this constitution, since the sectional shape of the water receptacle at least around the bottom side of the U-shape heat exchanger has gradients in the height direction and substantially symmetrical with respect to the substantial center of the heat exchanger, the air having flowed to the bottom side of the U-shape from the centrifugal blower is distributed to opposite sides, and equally distributed to the two air blowoff ports. Therefore, even when the height of the indoor unit is reduced, by lengthening the length of the heat exchanger, the effective area of the heat exchanger and the amount of blown air are increased, so that the cooling/heating capability can be increased and further an excellent air flow can be realized.

According to further aspect of the present invention there is provided a ceiling embedded type indoor unit comprising a unit body, a heat exchanger, a blower, an air inlet port and air blowoff ports, the unit body having a rectangular shape as seen from an indoor side and two air blowoff ports being provided on long sides of the rectangular shape, wherein the heat exchanger has a height of 220 to 260 mm, the air blowoff ports are extended from the heat exchanger in a longitudinal direction of the unit body, and the blower is of a centrifugal type disposed aside toward a side on which the air blowoff ports are extended relative to a substantial center of a length direction of the heat exchanger, and has a height of 80 to 120 mm, said indoor unit having cooling capability in the range of 6 to 10 kW.

With this constitution, since the height of the heat exchanger is in the range of 220 to 260 mm, and the height of the centrifugal blower is in the range of 80 to 120 mm, the height of the unit body can be 300 mm or less. The air blowoff ports are extended from the heat exchanger, and the centrifugal blower is disposed aside to the side on which the air blowoff ports are extended relative to the substantial center of the length direction of the heat exchanger. Therefore, without increasing the width of the unit body, the heat exchanger is lengthened, and the effective area of the heat exchanger and the amount of blown air are increased, so that the cooling capability can be in the range of 6 to 10 kW.

Furthermore, a plurality of centrifugal blowers can be provided in the above-described indoor unit, and a partition plate is provided between adjoining blowers.

Additionally, the U-shape heat exchanger may have one side of the U-shape which is longer than the other side thereof.

According to further aspect of the present invention there is provided a ceiling embedded type indoor unit comprising a unit body, a heat exchanger, a blower, an air inlet port, and air blowoff ports, wherein the heat exchanger is formed in a U-shape at least at a part thereof, the air blowoff ports are extended from an end of the heat exchanger, the blower is of a centrifugal type disposed inside the heat exchanger, and there is provided a water receptacle having a gradient in a height direction in such a manner that a sectional area of a flow path leading to the air blowoff ports from a substantial center of the centrifugal blower is expanded relative to a depth direction of the unit body.

With this constitution, the air blowoff ports are extended from a part of the U-shaped heat exchanger. Therefore, even when the air blowoff ports are lengthened relative to the length of the heat exchanger, the air from the centrifugal blower flows to the air blowoff ports via a part of the U-shaped heat exchanger, so that the area of the heat exchanger can be effectively used. Additionally, since the water receptacle is made such that the sectional area of the flow path is expanded toward the air blowoff ports, the airflow to the air blowoff ports becomes little loss and excellent.

DETAILED DESCRIPTION OF THE PREFERRED EMBODIMENTS

Embodiments of the present invention will now be described with reference to FIGS. 1 to 14.

Figure 4:
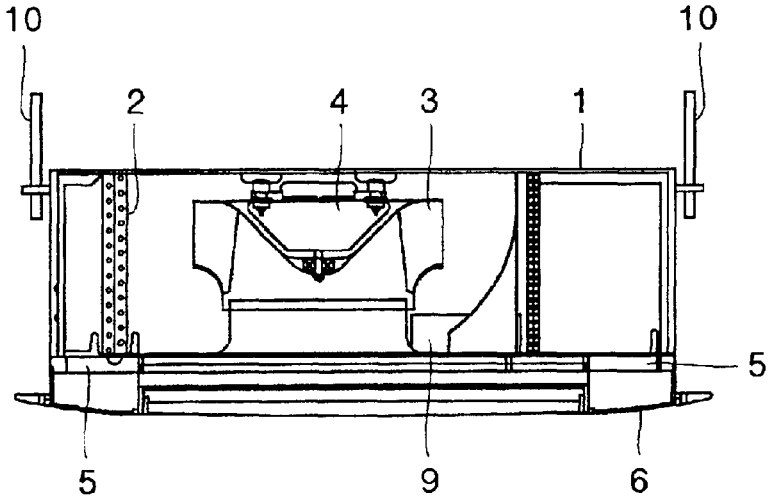
FIG. 4 is a sectional side view of the ceiling embedded type indoor unit according to the embodiment.
Figure 5:
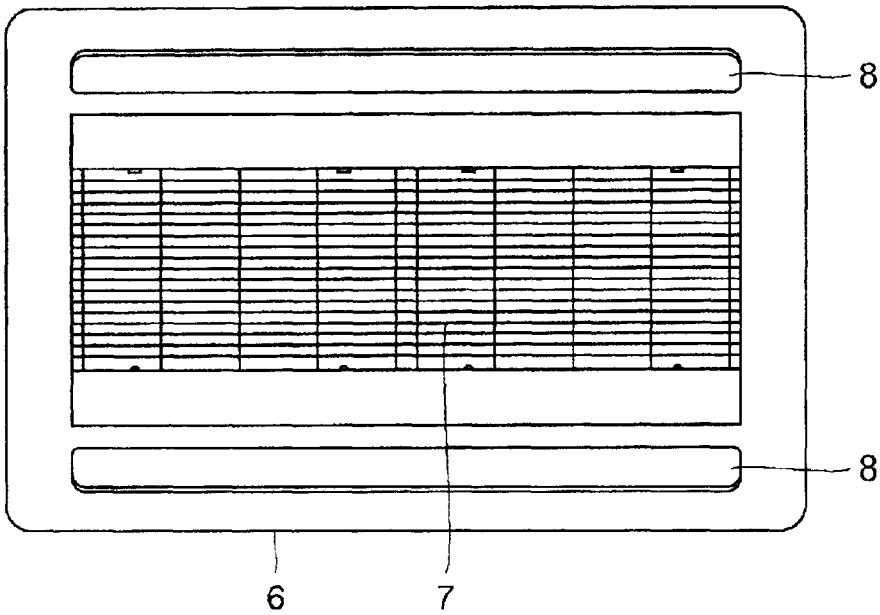
FIG. 5 is a front view showing a decorative panel of one embodiment of the ceiling embedded type indoor unit according to the present invention.

FIG. 4 is a sectional side view showing a structure of a ceiling embedded type two-direction blowoff indoor unit according to the present invention, and FIG. 5 is a front view of a decorative panel as seen from below. The indoor unit comprises a heat exchanger 2, a blower 3, a blower motor 4, a water receptacle 5 and an electric component box 9 in which electric components are installed, and these components are incorporated in a unit body 1. A decorative panel 6 is attached to the underside of the unit body, and the indoor unit is suspended from a ceiling (not shown) via suspending bolts 10 and attached.

The decorative panel 6 is provided with an air inlet port 7 at its central portion and air blowoff ports 8 at both ends of the air inlet port 7. The two-direction blowoff indoor unit denotes a type in which two air blowoff ports are provided as shown in FIG. 5. The indoor unit usually has a rectangular shape as seen from below or indoor side and two air blowoff ports are provided on long sides of the shape.

Figure 1:
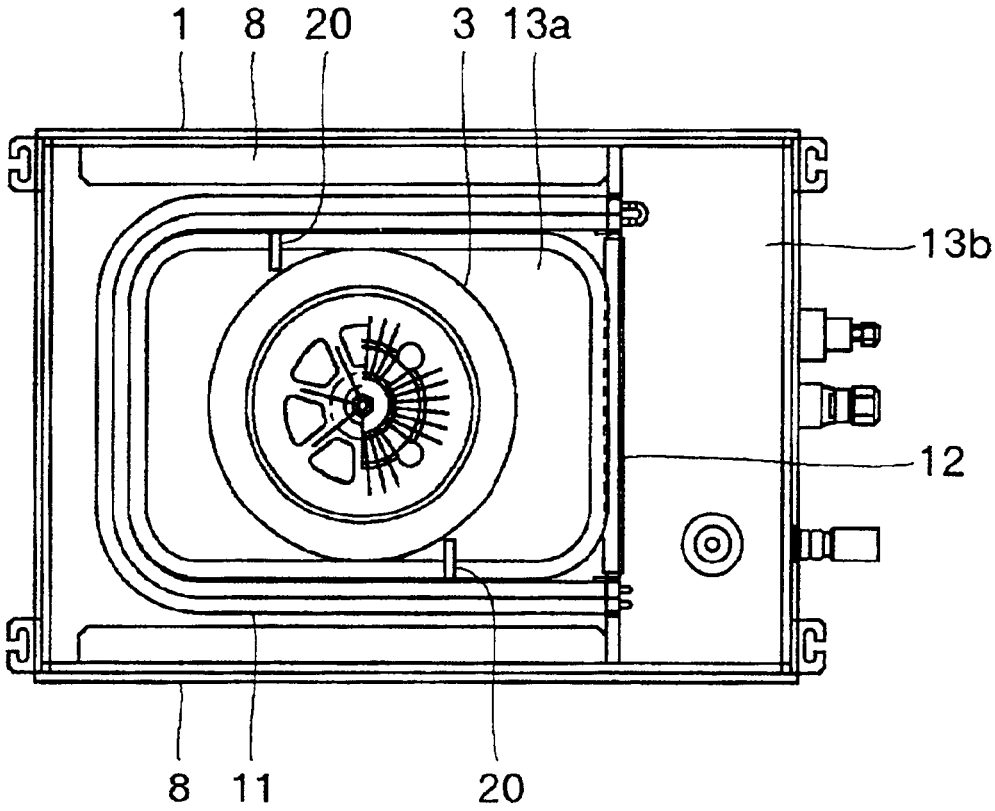
FIG. 1 is a front view showing an inner constitution of one embodiment of a ceiling embedded type indoor unit according to the present invention.
Figure 2:
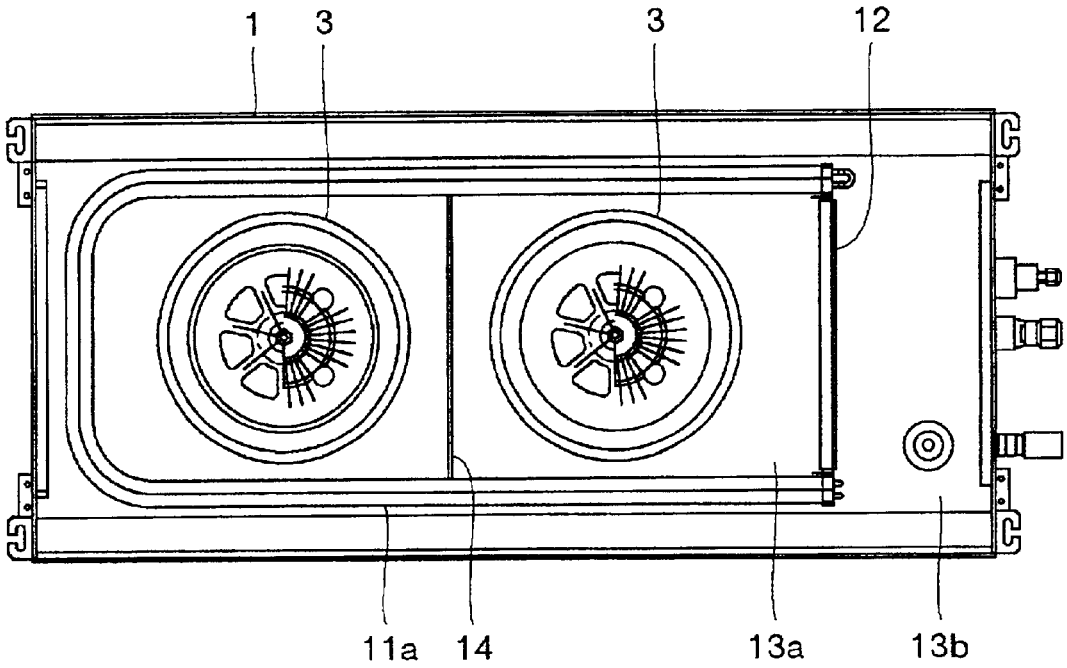
FIG. 2 is a front view showing an inner constitution of another embodiment of a ceiling embedded type indoor unit according to the present invention.

FIG. 1 is a front view showing an inner constitution of the unit body 1 of the ceiling embedded type indoor unit according to one embodiment of the present invention, and FIG. 2 is a front view showing the inner constitution of the unit body 1 of the ceiling embedded type indoor unit according to another embodiment of the present invention.

Figure 11:
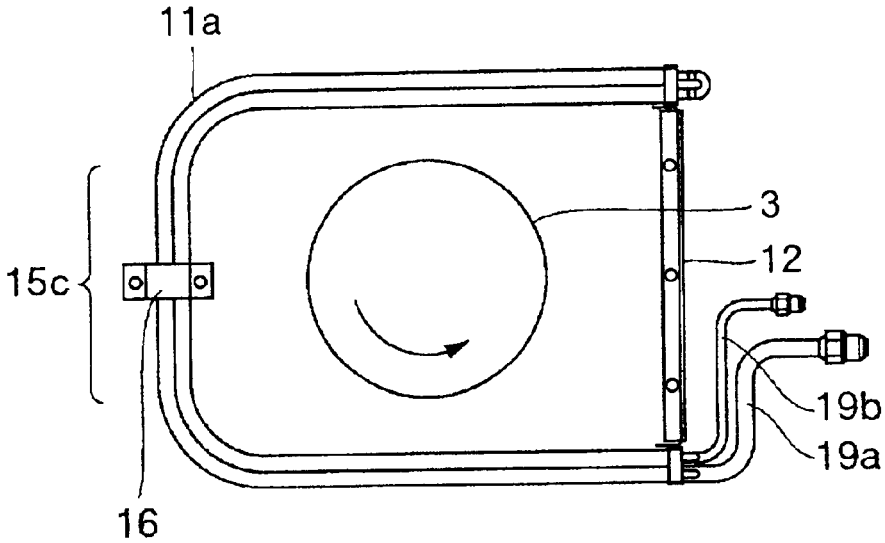
FIG. 11 is a front view showing a method of fixing the heat exchanger of one embodiment of the present invention.

In FIG. 1, at the central portion of the two-direction blowoff indoor unit disposed is one centrifugal blower 3, around which a heat exchanger 11 formed in a U-shape is arranged. A partition plate 12 is attached to one side of the heat exchanger 11 to separate a primary space 13*a* of the heat exchanger 11 from a secondary space 13*b*. The heat exchanger 11 is installed substantially in parallel with a longitudinal direction of the indoor unit. Specifically, the sides of the U-shape are disposed on long sides of the unit body 1, and one end of an open side of the U-shape is connected to header pipes 19*a*, 19*b* for circulating coolants as shown in FIG. 11.

Figure 7:
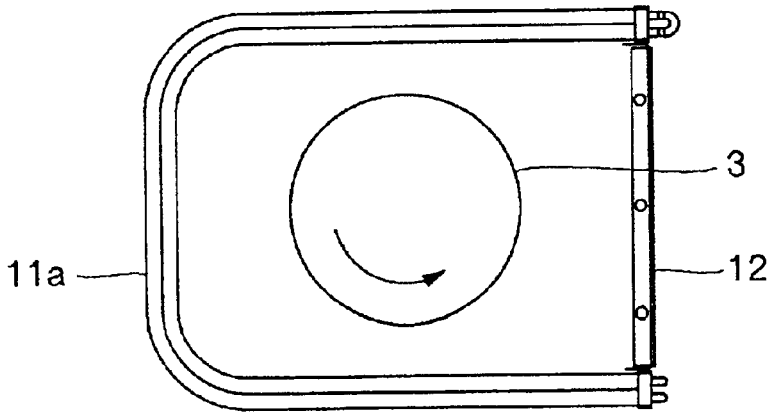
FIG. 7 is a front view showing a constitution of a U-shaped heat exchanger of one embodiment of the present invention.

Moreover, when the heat exchanger 11 is formed in the U-shape, two portions of a flat material of the heat exchanger 11 are bent at bending angles each of almost 90 degrees, for example, to provide a shape as shown in FIG. 7. Furthermore, the air blowoff ports 8 are extended from a bottom side of the U-shape heat exchanger 11, and the centrifugal blower 3 is disposed aside toward the bottom side of the U-shape relative to a substantial center of each side of the U-shape heat exchanger 11 in a length direction.

In the indoor unit shown in FIG. 2, two centrifugal blowers 3 are arranged in the unit body 1 and the heat exchanger 11 is disposed around the centrifugal blowers. Three or more centrifugal blowers 3 may be provided.

Advantages of the U-shaped heat exchanger 11 will be described.

Figure 12:
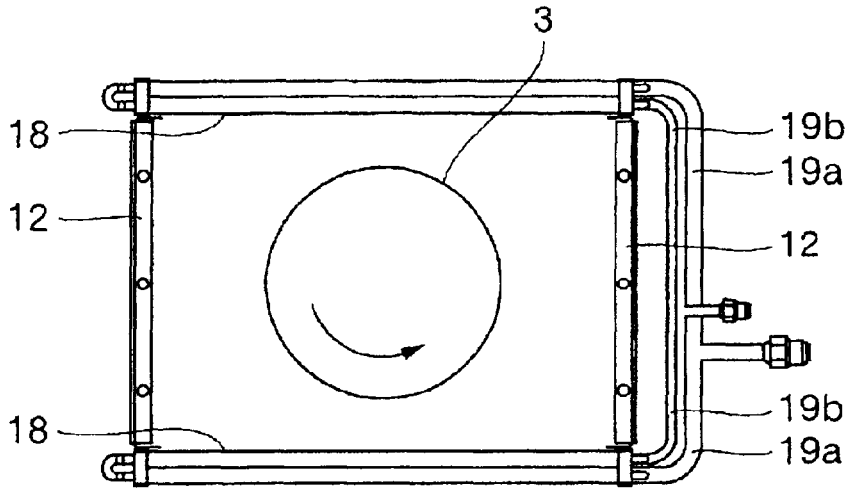
FIG.12 PRIOR ART
FIG. 12 is a front view showing a method of fixing a series of heat exchangers according to prior arts.

FIG. 12 shows a constitution of the heat exchanger 11 mounted inside the unit body 1 of a conventional two-direction blowoff ceiling embedded type indoor unit, and two series type heat exchangers 18 are arranged in series in correspondence with the air blowoff ports 8. The heat exchangers are easily arranged in blowing off air in two direction and the constitution is convenient.

When two series type heat exchangers 18 are used, however, each heat exchanger needs to be connected to gas-side and liquid-side header pipes 19*a*, 19*b*. As compared with when one heat exchanger is used, the number of components or assembly processes is remarkably increased. The constitution is also disadvantageous for cost reduction.

On the other hand, when the heat exchanger 11 is formed in the U-shape as shown in FIG. 1, it can be adapted to two air blowoff ports 8. Additionally, since the shape of the U-shape heat exchanger results in a shape of two heat exchangers being connected, the gas-side and liquid-side header pipes 19*a* and 19*b* for circulating the coolants may be provided on only one end of the open side of the U-shape. The constitution reduces the size of the unit body 1, and is further advantageous for cost and production respects.

Moreover, to increase the cooling capability as an air conditioner, it is essential to enlarge the area of the heat exchanger, but the series type heat exchanger 18 sometimes provides an insufficient total area of two exchangers. In the unit shown in FIG. 1, however, the area of the heat exchanger 11 is effectively used up to the bottom side of the U-shape.

Furthermore, the U-shaped heat exchanger 11, different from the prior-art circular heat exchanger, can enlarge the area thereof by lengthening only the side length of the U-shape. As compared with the circular heat exchanger or the like, the modification is remarkably easy. Therefore, when it is desired to finely adjust the cooling capability, it is sufficient only to adjust the length of the sides of the U-shape heat exchanger 11. As described above, the heat exchanger 11 according to one embodiment of the present invention has the U-shape which is easy to lengthen the length of the heat exchanger. Therefore, when the height of the indoor unit must be reduced, in other words, the height of the heat exchanger must be reduced, the same cooling/heating capability as that before the height is reduced is obtained by easily lengthen the length of the heat exchanger.

Moreover, when the unit body 1 is made small, a sufficient distance cannot be provided between the heat exchanger 11 and the centrifugal blower 3 due to dimensional restriction. In general, unless the distance is secured with 30 mm or more, wind cutting noise is generated. When a wind direction plate 20 is provided as shown in FIG. 1, however, the air flow distribution is improved, so that the distance between the heat exchanger 11 and the centrifugal blower 3 can be reduced.

Furthermore, when a plurality of centrifugal blowers 3 are provided as shown in the embodiment shown in FIG. 2, winds fed from the adjoining centrifugal blowers 3 interfere with each other, thereby increasing the noise. To solve the problem, by inserting a partition plate 14 between the centrifugal blowers 3, the mutual interference is prevented and the noise can be reduced. The partition plate 14 may be installed vertical to separate the centrifugal blowers 3, or inclined in consideration of air blow distribution.

Figure 6:
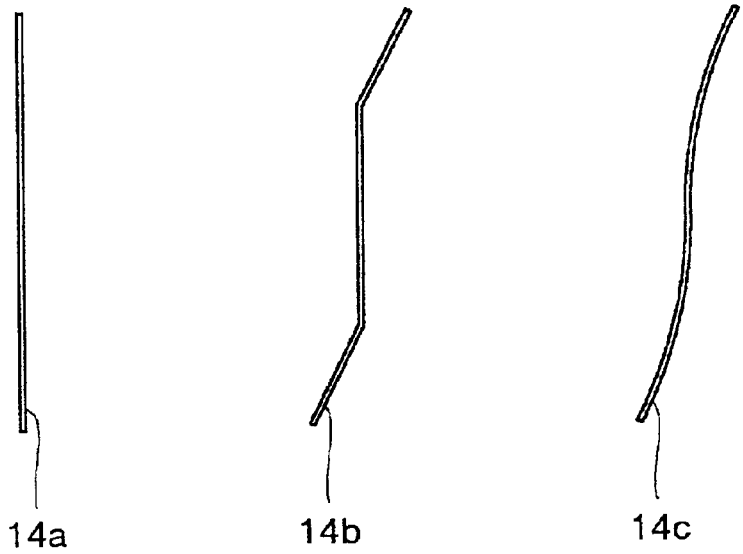
FIG. 6 is a sectional view showing a shape of blower partition plates of one embodiment of the present invention.

FIG. 6 is a side view showing a shape of the partition plate 14, which includes a flat shape 14*a*, a folded S-shape 14*b*, and a curved shape 14*c*. When the plate has a smooth curved S-shape like 14*c*, air flows smoothly, which provides a most effective noise countermeasure.

As described above, in the constitution shown in FIGS. 1 and 2, the height of the heat exchanger 11 is in the range of 220 to 260 mm, and can preferably be reduced to about 240 mm. Therefore, as regards installation, it is also preferable to set the width of the unit body in the range of 800 to 1500 mm, the depth in the range of 600 to 640 mm and the height in the range of 260 to 300 mm. The effective area of the heat exchanger can be enlarged, and the air blowoff ports 8 can sufficiently be lengthened.

Moreover, when the cooling capability is 8.0 kW or less, the unit body 1 of the indoor unit preferably has a width of 860 mm, depth of 620 mm, and height of 300 mm. When the cooling capability exceeds 8.0 kW, the width of 1440 mm, depth of 620 mm, and height of about 300 mm are preferable. In either case, the height can be 300 mm or less. Additionally, when the height is 300 mm or less, installation can be realized even for a module with a ceiling dimension of 300 mm.

Furthermore, when the height of the heat exchanger 11 is set in the range of 220 to 260 mm, the height of the centrifugal blower 3 is set in the range of 80 to 120 mm and the height of the unit body 1 is set to 300 mm or less, the effective area of the heat exchanger 11 and the amount of blown air are increased so that the cooling capability can sufficiently be in the range of 6 to 10 kW. The two-direction blowoff ceiling embedded type indoor unit can be reduced in size for its capability.

Figure 3:
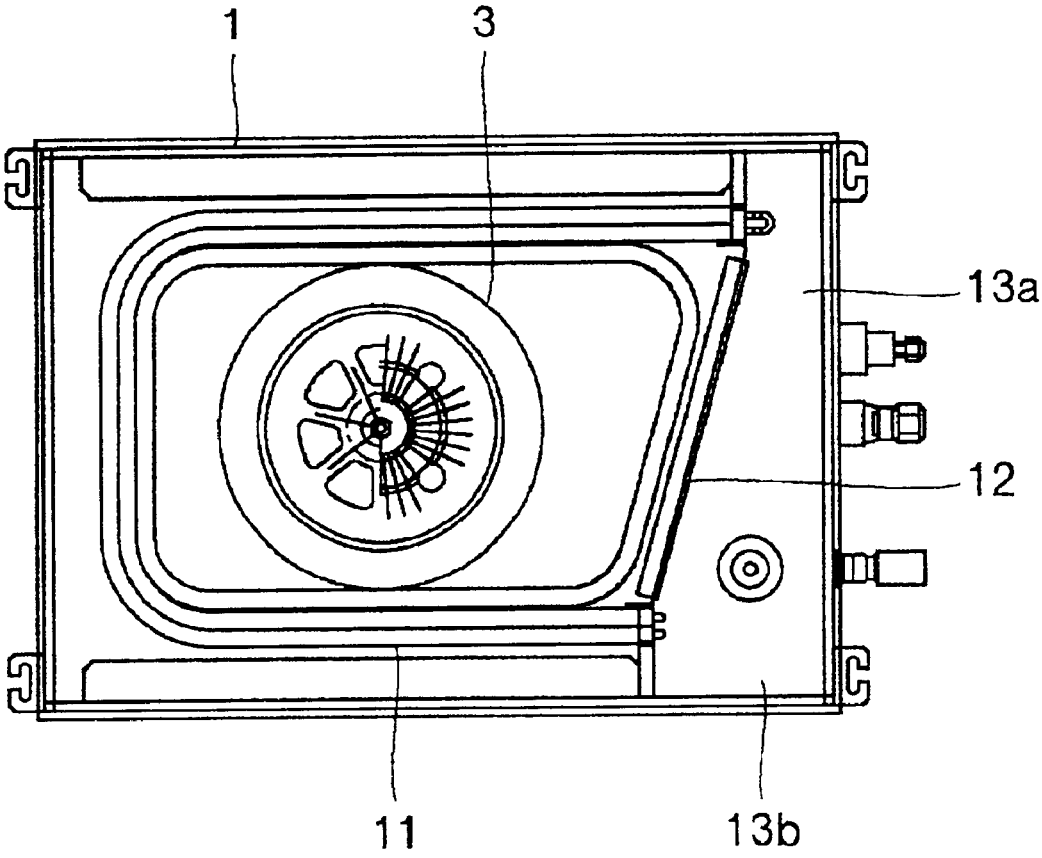
FIG. 3 is a front view showing an inner constitution of a further embodiment of a ceiling embedded type indoor unit according to the present invention.

FIG. 3 is a front view showing the inner constitution of the unit body 1 of the ceiling embedded type indoor unit according to still further embodiment, and one open side of the U-shape heat exchanger 11 around the centrifugal blower 3 is lengthened to provide an offset constitution.

Figure 8:
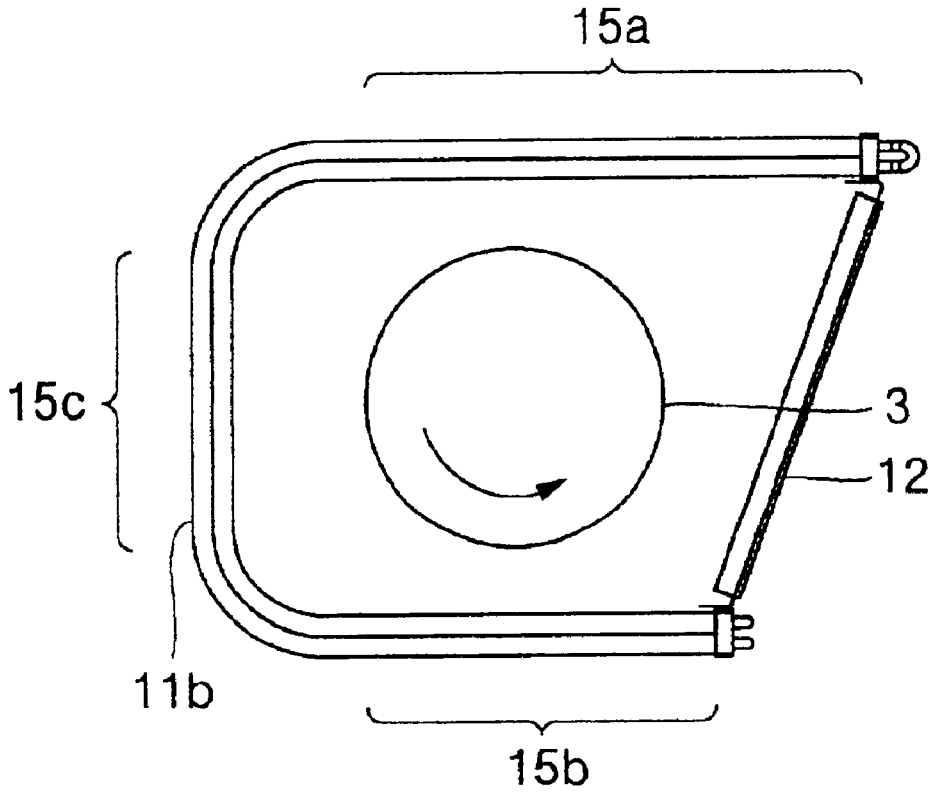
FIG. 8 is a front view showing a constitution of a heat exchanger of another embodiment of the present invention.

FIG. 8 is a front view showing the inner constitution of the unit body of the offset heat exchanger, and the centrifugal blower 3 blows air in a circumferential direction, so that the blower rotates in a direction shown by an arrow. Therefore, the upstream side of the centrifugal blower 3 has a larger amount of air, and the side length of the heat exchanger 11 on the larger air amount side, i.e., a long side 15*a* of the U-shape is longer than a short side 15*b* on a downstream side. Thereby, the heat exchange performance can be enhanced without increasing the width of the unit body 1.

Furthermore, since each side length of the heat exchanger 11 can easily be changed, the air amounts of air blown from two blowoff ports can be equalized on opposite sides by adjusting the length. Conversely, when it is desired to increase the air amount of one of the air blowoff ports 8, only the length of the heat exchanger 11 may be adjusted. Additionally, not only the air amount but also the temperature of blown air can easily be equalized or unbalanced on opposite sides. Furthermore, the heat exchanger is adapted to the arrangement of the electric component box or the like, and the space utilization factor can be enhanced.

In the two-direction blowoff, when the heat exchanger is formed in the U-shape, the bottom side 15*c* of the U-shape has no air blowoff port 8. Therefore, the air flowing toward the bottom side 15*c* of the U-shape is passed through the heat exchanger 11, distributed to opposite sides, and separately blown off via two air blowoff ports 8. To equally distribute the air blown from the two air blowoff ports 8, the shape of the water receptacle around the bottom side 15*c* of the U-shape is important.

Figure 9B:
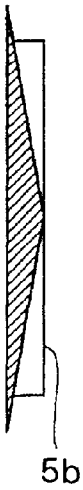
FIGS. 9B and 9C are sectional views of the water receptacle taken along lines IXB—IXB and IXC—IXC in FIG. 9A, respectively.
Figure 9A:
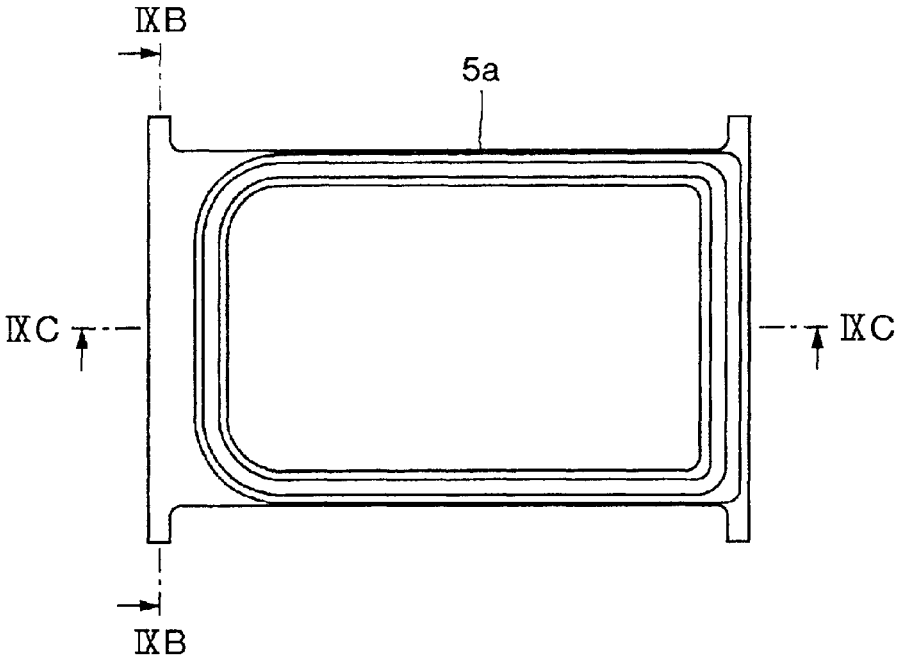
FIG. 9A is a front view showing a relationship and configuration of the heat exchanger and the water receptacle of one embodiment of the present invention.
Figure 9C:
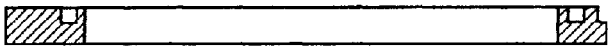
Figure 10A:
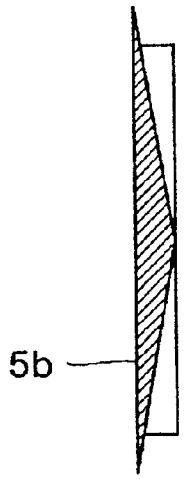
FIGS. 10A and 10B are sectional views of the water receptacle of one embodiment of the present invention.
Figure 10B:
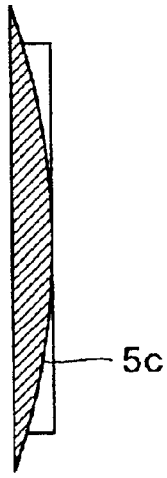

FIGS. 9 and 10 are a front view of the unit body 1 showing the relationship and configuration of heat exchanger 11 and water receptacle 5 and sectional views of the water receptacle. Reference numeral 5*a* denotes a front view of the water receptacle 5, and 5*b*, 5*c* denote sectional views around the bottom side 15*c* of the U-shape.

To improve the distribution of the air passing through the bottom side 15*c* of the U-shape heat exchanger 11, the sectional shape of the water receptacle 5 has gradients in the height direction of the unit body 1 and in symmetrical with respect to the center of the water receptacle 5, as shown in FIG. 9B taken along line IXB—IXB in FIG. 9A. Moreover, the sectional shape of the water receptacle 5 is preferably rounded to provide a smoothly curved shape as shown by 5*c* in FIG. 10B.

As described above, when the shape of the water receptacle 5 is adjusted, the air distribution can be improved, and the direction of air blown via the air blowoff ports 8 can be changed. For example, when the shape is moderately rounded, the air from the air blowoff ports 8 flows rather in a horizontal direction. On the other hand, when it is provided with a steep gradient, the air flows perpendicularly from the air blowoff ports.

FIG. 11 is a front view showing a method of fixing the heat exchanger 11 to the unit body 1, and the open side of the U-shape and the bottom side 15*c* of the U-shape are fixedly screwed to a housing which is the unit body 1 through a heat exchanger partition plate 12 and a heat exchanger support plate 16, respectively.

Moreover, the U-shaped heat exchanger 11 can be used not only for the two-direction blowoff but also for three-direction blowoff by adding another air blowoff port to the bottom side 15*c* of the U-shape.

Figure 13:
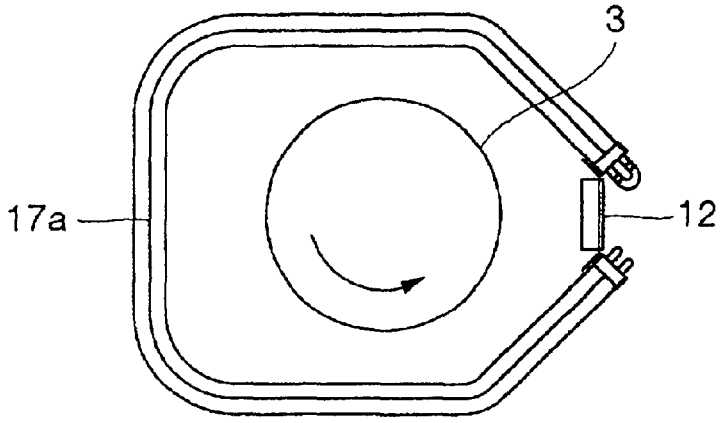
FIG. 13 is a front view showing a modification of the heat exchanger of another embodiment of the present invention.
Figure 14:
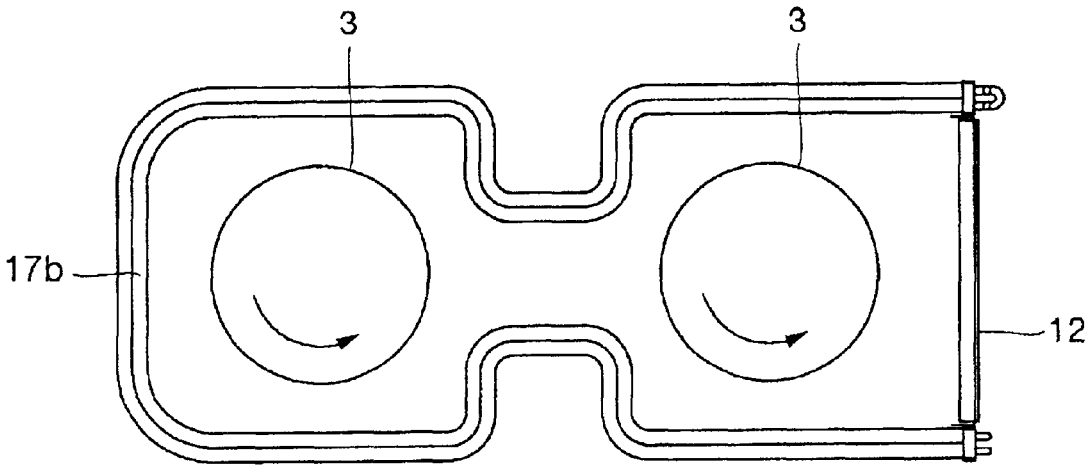
FIG. 14 is a front view showing a modification of the heat exchanger of a still further embodiment of the present invention.

FIGS. 13 and 14 are front views showing modifications of the U-shaped heat exchanger 11 according to other embodiments. Specifically, the heat exchanger 11 is formed in the shape of character C or 8 as shown in the drawings. In the heat exchanger shown in FIG. 13, the tip end of the U-shape may additionally be bent, so that the total area for receiving the air from the blower can be increased.

Moreover, in the heat exchanger shown in FIG. 14, a part of the U-shape is narrowed, so that when two centrifugal blowers 3 are arranged, both of them can separately be surrounded. Therefore, the air from the centrifugal blower 3 can more efficiently be subjected to heat exchange. This constitution also provides an advantage that a partition plate needed between the centrifugal blowers 3 can be omitted.

As described above, according to the present invention, the heat exchanger is formed in the U-shape, the air blowoff ports are arranged to extend from the bottom side of the U-shape, and the centrifugal blower is disposed aside toward the bottom side. Therefore, even when the height of the heat exchanger is reduced relative to the width dimension of the unit body, the effective area can be enlarged, and the air blowoff ports can be sufficiently lengthened. Consequently, even when the height of the indoor unit is reduced, the ceiling embedded type indoor unit which is large in cooling/heating capability and excellent in air flow distribution can be obtained.

Moreover, according to the present invention, the heat exchanger is formed in the U-shape with its height being in the range of 220 to 260 mm, the centrifugal blower is arranged aside to the bottom side of the U-shape, and the air blowoff ports are constituted to extend from the bottom side of the U-shape. The air blowoff ports can be sufficiently lengthened with respect to the unit body having a width of 800 to 1500 mm and depth of 600 to 640 mm. Therefore, the ceiling embedded type indoor unit can be obtained which is effectively used up to the tip end of the heat exchanger.

Furthermore, according to the present invention, since the sectional shape of the water receptacle at least around the bottom side of the U-shape heat exchanger has gradients in the height direction of the unit body 1 and in symmetrical with respect to the center of the heat exchanger, the air from the centrifugal blower is equally distributed to two air blowoff ports. Therefore, even when the indoor unit is reduced in height and the air blowoff ports are lengthened, the ceiling embedded type indoor unit excellent in air flow can be obtained.

Additionally, according to the present invention, the air blowoff ports are extended from the heat exchanger having a height of 220 to 260 mm, the centrifugal blower having a height of 80 to 120 mm is disposed aside toward the side from which the air blowoff ports are extended, and the cooling capability is in the range of 6 to 10 kW. Therefore, the ceiling embedded type indoor unit can be obtained in which the unit body has a height of 300 mm or less and the effective area of the heat exchanger and the amount of blown air are increased without increasing the width of the unit body.

Moreover, according to the present invention, the air blowoff ports are disposed to extend from a part of the U-shaped heat exchanger, and the water receptacle is made such that the sectional area of the water receptacle is enlarged toward the air blowoff ports. Therefore, even when the air blowoff port is longer than the heat exchanger, the air from the centrifugal blower can pass to the air blowoff port through the U-shaped part of the heat exchanger, so that the ceiling embedded type indoor unit can be obtained in which the area of the heat exchanger can effectively be used and there is little loss in the flow to the air blowoff port.

What is claimed is:

1. A ceiling embedded type indoor unit comprising a unit body, a heat exchanger, a blower unit, an air inlet port, and air blowoff ports, said unit body being formed in a rectangular shape as seen from an indoor side and provided with two said air blowoff ports on long sides thereof, and which is installed to be embedded in a ceiling, wherein said heat exchanger is formed in a U-shape, sides of the U-shape are disposed on the long sides of said unit body, one end of an open side of the U-shape is connected to a header pipe for circulating a coolant, said air blowoff ports are extended beyond a bottom side of said U-shape heat exchanger in a longitudinal direction of said unit body, said blower unit including at least one blower of a centrifugal type, said blower unit being disposed toward the bottom side of the U-shape heat exchanger with respect to a substantial center of a length direction of the sides of said U-shape heat exchanger; and a wind direction plate between said blower unit and said heat exchanger to reduce wind noise.

2. The ceiling embedded type indoor unit according to claim 1, wherein said blower unit includes a plurality of said centrifugal blowers and a partition plate between the centrifugal blowers.

3. The ceiling embedded type indoor unit according to claim 1, wherein one side of said U-shaped heat exchanger is longer than the other side of said U-shaped heat exchanger.

4. The ceiling embedded type indoor unit according to claim 1, wherein said heat exchanger has height of 220 to 260 mm, and said unit body is provided with the blowoff ports on two sides, respectively, and has a width of 800 to 1500 mm, a depth of 600 to 640 mm and a height of 260 to 300 mm.

5. The ceiling embedded type indoor unit according to claim 1, further comprising a water receptacle having a sectional shape with gradients in a height direction and substantially symmetrical with respect to the substantial center of a depth direction of said unit body at the bottom side of said U-shape heat exchanger.

6. The ceiling embedded type indoor unit according to claim 1, wherein said heat exchanger has a height in the range of 220 to 260 mm, said blower has a height in the range of 80 to 120 mm, and said indoor unit has a cooling capability in the range of 6 to 10 kW.

7. The ceiling embedded type indoor unit according to claim 1, further comprising a water receptacle having a gradient in a height direction so that a sectional area of a flow path leading to said air blow off ports from a substantial center of at least one blower of said centrifugal type is expanded relative to a depth direction of said unit body.

* * * * *

UNITED STATES PATENT AND TRADEMARK OFFICE

CERTIFICATE OF CORRECTION

PATENT NO. : 6,948,552 B2
APPLICATION NO. : 09/978631
DATED : September 27, 2005
INVENTOR(S) : Kosugi et al It is certified that error appears in the above-identified patent and that said Letters Patent is hereby corrected as shown below:

(30) Foreign Application Priority Data

July 29, 1998 (JP) ……. 10-213714

Signed and Sealed this

Twelfth Day of September, 2006

JON W. DUDAS
*Director of the United States Patent and Trademark Office*